United States Patent [19]

Evensen

[11] Patent Number: 4,646,317

[45] **Date of Patent: * Feb. 24, 1987**

[54] ELECTRODE HOLDER SYSTEM FOR ELECTROTHERMIC SMELTING FURNACES

[75] Inventor: Knut Evensen, Oslo, Norway

[73] Assignee: Elkem a/s, Oslo, Norway

[ * ] Notice: The portion of the term of this patent subsequent to Sep. 24, 2002 has been disclaimed.

[21] Appl. No.: 752,896

[22] Filed: Jul. 8, 1985

Related U.S. Application Data

[63] Continuation-in-part of Ser. No. 554,896, Nov. 25, 1983, Pat. No. 4,543,656.

[51] Int. Cl.[4] ..... H05B 7/10

[52] U.S. Cl. ..... 373/101; 373/94

[58] Field of Search ..... 373/94, 95, 96, 97, 373/100, 101, 105

[56] References Cited

U.S. PATENT DOCUMENTS 2,778,865 1/1957 Kongsgaarden ..... 373/100

4,543,656 9/1985 Evensen ..... 373/101

*Primary Examiner*—Roy N. Envall, Jr.

*Attorney, Agent, or Firm*—Lucas & Just

[57] ABSTRACT

Electrode holder system for electrothermic smelting furnaces comprising current clamps for conducting electric current to an electrode and hydraulic cylinders for moving the electrode up and down. The cylinders are connected to the electrode via an electrode frame and releasable clamping means. At least two vertical rails are arranged parallel to the electrode. The rails are at their upper ends suspended from a suspension frame and have a stopper means on their lower ends. The stopper means represents the lower limit for the movement of the current clamps. The electrode holder system combines regulation of the tip position with automatic feeding of the electrode.

5 Claims, 6 Drawing Figures

ELECTRODE HOLDER SYSTEM FOR ELECTROTHERMIC SMELTING FURNACES

This is a continuation-in-part application of copending application Ser. No. 554,896 filed Nov. 25, 1983 now U.S. Pat. No. 4,543,656.

The present invention relates to an electrode holder system for electrodes in electrothermic smelting furnaces. The electrode holder system according to the invention can be used for prebaked electrodes and for electrodes of the Soederberg type.

The known electrode holder systems for electrodes in electrothermic smelting furnaces comprise one set of hydraulic cylinders for regulating the tip position of the electrode and one set of hydraulic cylinders for feeding the electrode. Further, current clamps for conducting current to the electrodes are usually suspended from an electrode frame.

In the known electrode holder system the tip position of the electrode is regulated automatically or manually based upon variations in the electrical resistance in the furnace. The electrode consumption has to be compensated for by feeding the electrode. Electrode feeding is usually based upon an emperical basis. Automatic feeding can for example be based upon used kWh's. The aim is that electrode consumption and electrode feeding shall be balanced in such a way that an approximately constant distance can be maintained between the electrode tip and the current clamps where current is conducted to the electrode.

The known electrode holder systems with one set of hydraulic cylinders for regulating the tip position of the electrode, one set of hydraulic cylinders for feeding of the electrode and with the current clamps suspended from an electrode frame have many disadvantages and drawbacks:

High investment costs.

They are place consuming which makes maintenance work difficult, and therefore the furnace usually has to be shut down for maintenance work on the electrode holder system with subsequent loss of production.

Feeding of the electrode must be done on an emperical basis which is only approximately equal to actual electrode consumption. Adjustment is therefore sometimes necessary.

The present invention aims at overcoming the disadvantages and drawbacks of the previously known electrode holder systems.

This is obtained by means of the electrode holder system of the invention where the regulation of the tip position of the electrode is combined with automatic feeding of the electrode.

Accordingly, the present invention relates to an electrode holder system for electrothermic smelting furances where the electrode holder system comprises current clamps for conducting electric current to the electrode and hydraulic cylinders which via a frame and clamping means arranged on said frame, are releasably connected to the electrode. The hydraulic cylinders are intended to regulate the electrode up and down. The invention is characterized by at least two vertical rails which are arranged parallel to the electrode at a distance from the periphery of the electrode, which rails at their upper ends are suspended from a suspension frame and at its lower ends are furnished with a stopper means for the current clamps. The stopper means is the lower limit for the downward movement of the current clamps.

As the downward movement of the current clamps is limited by the stopper means the feeding of the electrode will take place automatically when the hydraulic cylinders for regulating the electrode are moved in downward direction with the current clamps resting on the stopper means.

By the electrode holder system of the invention the current clamps are not suspended from a frame, but are only pressed against the electrode by a contact pressure that is high enough to carry the weight of the electrode.

One embodiment of the present invention will now be described with reference to the drawings wherein.

Figure 1:
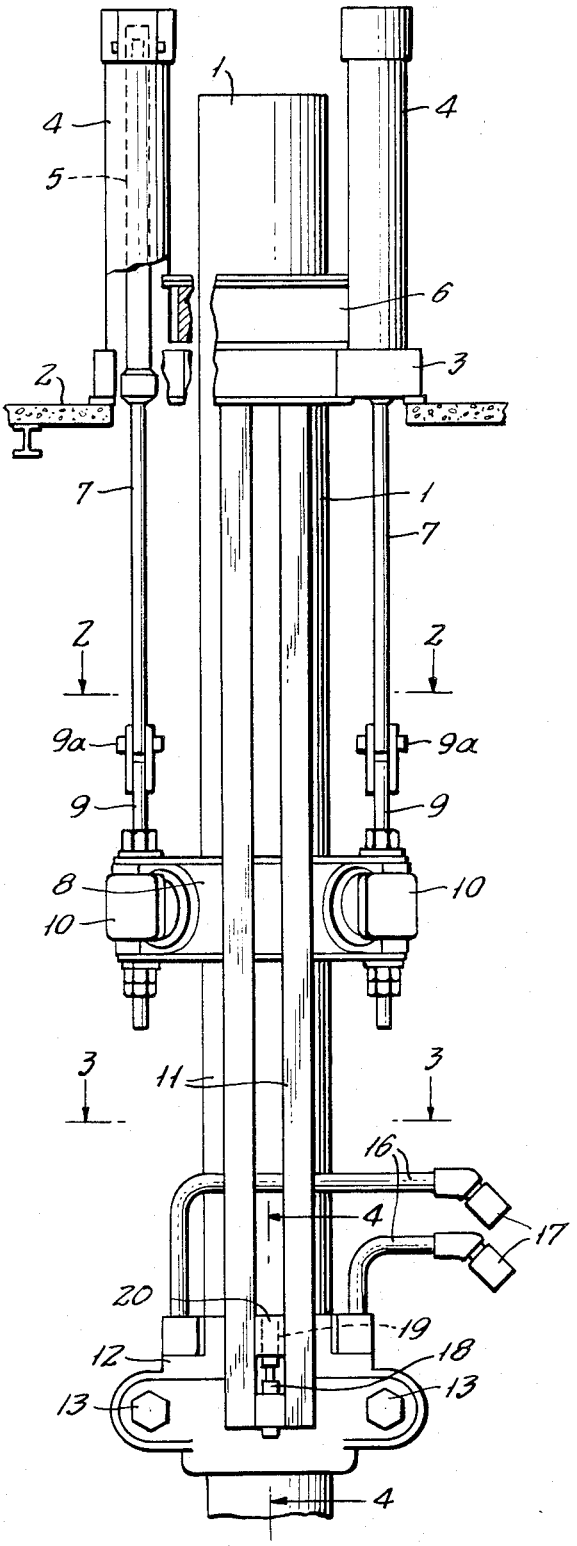
FIG. 1 is a vertical front elevation of the electrode holder system according to the present invention.

FIG. 1 shows an electrode 1 suspended in an electrode holder system according to the present invention. The electrode 1 and the electrode holder system are supported on a floor 2. A suspension frame 3 is resting on the floor 2. To the suspension frame 3 there are connected two frames 4 which are carrying two hydraulic cylinders 5. An annular ring 6 with an opening for the electrode 1 is secured to the suspension frame 3.

Figure 2:
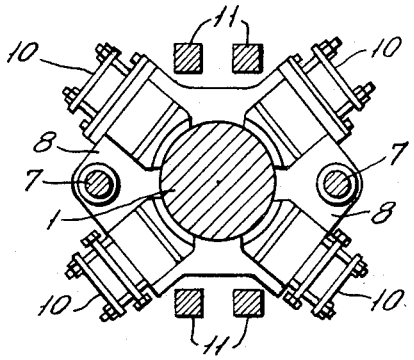
FIG. 2 is a horizontal view taken along line A—A in FIG. 1.

The pistons 7 of the hydraulic cylinders 5 are at their lower ends connected to an annular electrode frame 8 by means of rods 9 and bolts 9*a*. As shown on FIG. 2, the electrode frame 8 is arranged around the electrode 1 and is equipped with a plurality of clamping means 10 arranged radially to the electrode 1. The clamping means 10 are intended to exert a releasable pressure on the electrode, the pressure being high enough to carry the weight of the electrode 1 with appurtenant equipment via the suspension frame 8 and the hydraulic cylinders 5. The clamping means 10 can be of any known type. The pressure on the clamping means 10 can preferably be released by means of remote control. When the pressure on the clamping means 10 is released, the hydraulic cylinders 5 with the electrode frame 8 can be moved freely up and down relative to the electrode. By normal operation the pressure on the clamping means 10 is only released when the pistons 7 of the hydraulic cylinders 5 are in their lower position and therefore have to be lifed to a higher position on the electrode.

Figure 3:
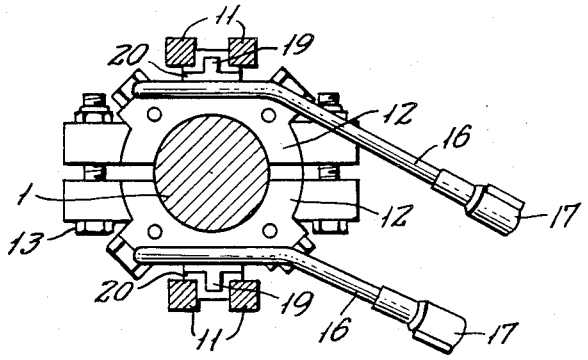
FIG. 3 is a horizontal view taken along line B—B in FIG. 1.

A plurality of vertical rails 11 are suspended from the suspension frame 3. In the embodiment of the invention shown on the FIGS. 2 and 3 there are arranged four vertical rails 11. The rails 11 are arranged parallel to the electrode 1.

The function of the verticals rails 11 will be described below.

Electric current is conducted to the electrode 1 in conventional way through the current clamps 12. In the embodiment of the invention shown on the drawings there is arranged two current clamps on each electrode. The current clamps are pressed against the electrode by means of bolts 13 and springs which are parts of the current clamps 12. The current clamps 12 must exert a pressure on the electrode which is high enough to carry the weight of the electrode.

The current clamps 12 have at their upper ends radial shoulder parts 19 which are intended to be in contact with and be guided by the rails 11. The current clamps are further equipped with current conducting pipes 16 and with connecting means 17 by means of which flexibles (not shown) are connected to the current conducting pipes 16.

Figure 4:
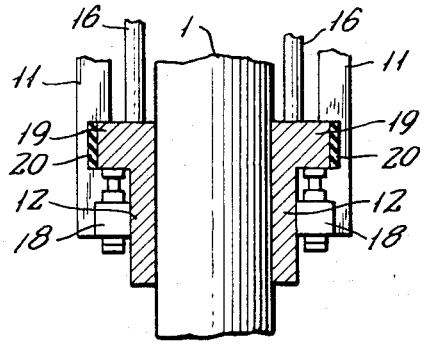
FIG. 4 is a vertical view taken along line C—C in FIG. 1.

On the lower ends of the rails 11 there are arranged stopper means 18 which act on the shoulders 19 on the contact clamps 12 and which are intended to support the current clamps. Hence the lowest possible position of the current clamps 12 is reached when the radial shoulder parts 19 of the current clamps 12 are resting on the stopper 18. The current clamps 12 are equipped with electric insulation 20 on the radial shoulder part 19 in order to insulate the current clamps 12 from the rails 11. On FIGS. 1 and 4 the current clamps 12 are shown in their lowest possible position.

The electrode holder system according to the present invention operates in the following way:

In order to regulate the tip position upwards the hydraulic cylinders 5 are lifted. The current clamps will then follow upwards together with the electrode and will be guided by the rails 11. When a downward movement of the electrode is necessary and the current clamps are in their lowest possible position, that is, the current clamps are resting on the stopper means 18, the hydraulic cylinders 5 will via the electrode frame 8 and the clamping means 10, force the electrode down through the current clamps 12. In this way a fully automatic feeding of the electrode is achieved at the same time as the tip position of the electrode always will be kept in the optimal position.

When the pistons 7 of the hydrualic cylinders 5 are in the lowest possible position, the current clamps 12 will always be resting on the stopper means 18. The pressure on the clamping means can then be released. The weight of the electrode 2 will then be carried by the current clamps, the stopper means 18 and the rails 11. When the pressure on the clamping means 10 is released, the pistons 7 with the electrode frame 8 and the clamping means 10, can be lifted relative to the electrode, whereafter the pressure on the clamping means again is actuated. In this way a "change of the grip" on the electrode is obtained.

Figure 5:
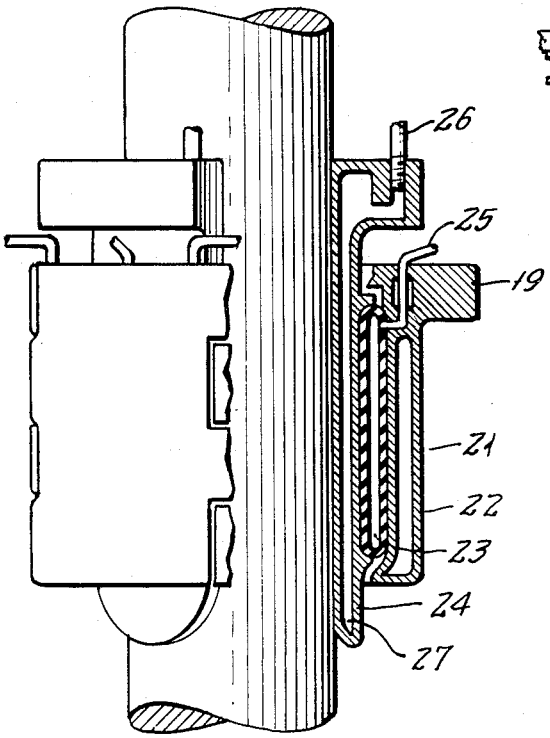
FIG. 5 is a vertical front elevation of one embodiment of the electrode holder system showing a pressure ring for exerting pressure against the current clamp.

According to another embodiment of the present invention, the pressure on the current clamps can be exerted by means of a pressure ring consisting of one outer segment and a membrane for each current clamp. Between each outer segment and the corresponding current clamp there is arranged a membrane to which pressure can be exerted to achieve a sufficient pressure between the outer segment and the current clamps. In this case the pressure ring is furnished with radial shoulder parts which are intended to rest on the stopper means on the lower ends of the rails. As shown in FIG. 5, each pressure ring 21 is made up of one outer segment 22 and a membrane 23 for each current clamp 24. Between each outer segment 22 of pressure ring 21 and the corresponding current clamp 24 there is arranged membrane 23 to which pressure can be exerted through tube 25 to achieve a sufficient pressure between pressure ring 21 and current clamp 24 to function in the manner described above. As shown in FIG. 5, pressure ring 21 is furnished with radial shoulder parts 19 which are intended to rest on stopper means 18 at the lower ends of vertical rails 11. Also shown in FIG. 5 are tube 26 which allow cooling fluid to flow into compartment 27 to cool current clamp 24.

Figure 6:
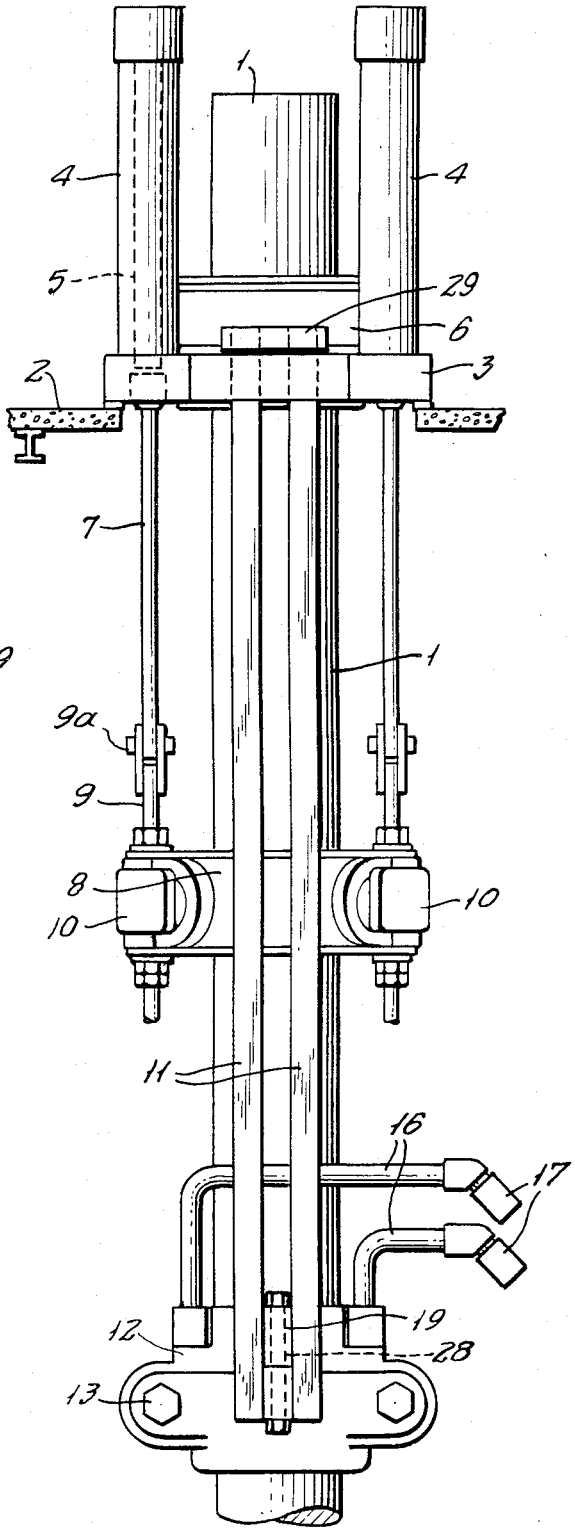
FIG. 6 is a vertical front elevation of another embodiment of the electrode holding system in which the vertical rails are affixed to the current clamp.

In still another embodiment of the present invention, vertical rails 11 are affixed at their lower ends to shoulder part 19 of current clamp 12. FIG. 6 shows vertical rails 11 affixed, at their lower ends, to shoulder part 19 by means of a nut and bolt 28. In this embodiment, stopper means 18 as shown in FIG. 1 is removed. Any means can be employed to affix the lower end of vertical rails 11 to shoulder part 19. The upper end of vertical rails 11 are not affixed to suspension frame 3 when the lower end of vertical rails 11 are affixed to shoulder part 19. Instead, vertical rails 11 have a stopper means 29 which cooperates with suspension frame 3 and rests on suspension frame 3 when current clamp 12 is in its lowest position as shown in FIG. 6. Vertical rails 11 will normally move up and down together with electrode 1. The movement of electrode 1 is regulated by hydraulic cylinder 5. When stopper means 29 rests on suspension frame 3 a further downward movement of electrode 1 is accomplished by hydraulic cylinder 5 pressing electrode 1 down through the current clamp 12, thus feeding electrode 1 into the furnace. This embodiment is especially advantageous because vertical rails 11 and current clamp 12 will always follow the movement of electrode 1. Also the lowest position of vertical rails 11 will always be in the same position as current clamp 12. When stopper means 29 rests on suspension frame 3, clamping means 10 can be released and moved to a different clamping position on electrode 1. During such movement of clamping means 10, the full weight of the electrode is borne by current clamping means 12 and vertical rails 11.

It should be mentioned that it is within the scope of the invention to use standing cylinders for the regulation of the electrode. The clamping means on the electrode frame can be of any known kind, for example hydraulic clamping means or spring loaded clamping means. The number of current clamps is not essential for the present invention. Even if there is used two current clamps on the embodiment of the invention shown on the figures, it is within the scope of the invention to use a plurality of current clamps, for example four or eight.

Further, it is within the scope of the invention to furnish those parts of the electrode holder system which are exposed to high temperature with water-cooling, especially the current clamps, the pressure ring and the stopper means.

It will be understood that it is intended to cover all changes and modifications of the preferred embodiment of the invention herein chosen for the purpose of illustration which do not constitute a departure from the spirit and scope of the invention.

What is claimed is:

1. An electrode holding system for electrothermic smelting furnace comprising:

(a) a suspension frame resting entirely on top of a smelting furnace;

(b) two vertical rails suspended at their upper ends from said suspension frame, said rails being parallel to an electrode;

(c) stopper means connected to the lower end of said vertical rails;

(d) an electrode frame;

(e) releasable clamping means connected to said electrode and to said electrode frame;

(f) current clamping means conducting current to said electrode, connected to said electrode, wherein said current clamping means is a pressure ring and a current clamp, said stopper means representing the lowest limit for downward movement of said current clamping means; and (g) hydraulic means connected to said electrode frame and to said suspension frame for moving said electrode up and down.

2. Electrode holder system according to claim 1 characterized in that the current clamping means have radial shoulder parts which rest on the stopper means when the current clamping means are in their lowest position.

3. Electrode holder system according to claim 2 characterized in that the shoulder parts cooperate with the rails so that the current clamping means are guided by the rails when the electrode is moved up and down.

4. An electrode holding system for electrothermic smelting furance comprising:

(a) a suspension frame resting entirely on top of a smelting furance;

(b) an electrode frame;

(c) releasable clamping means connected to said electrode and to said electrode frame;

(d) current clamping means conducting current to an electrode, connected to said electrode;

(e) two vertical rails affixed at their lower end to said current clamping means, said rails being parallel to said electrode;

(f) stopper means connected to the upper end of said vertical rails, said stopper means representing the lowest limit for downward movement of said current clamping means when said stopper means rests upon said suspension frame; and (g) hydraulic means connected to said electrode frame and to said suspension frame for moving said electrode up and down.

5. The electrode holding system of claim 4 wherein said current clamping means comprises a pressure ring and a current clamp said pressure ring pressing said current clamps against said electrode.

* * * * *